United States Patent [19]

Johnston

[11] 4,376,317

[45] Mar. 15, 1983

[54] FOLDABLE STEP ARRANGEMENT FOR BEDS

[75] Inventor: Bruce L. Johnston, Shawnee, Kans.

[73] Assignee: Burke, Inc., Mission, Kans.

[21] Appl. No.: 280,807

[22] Filed: Jul. 6, 1981

[51] Int. Cl.[3] ..... A61G 7/06

[52] U.S. Cl. ..... 5/80; 5/68

[58] Field of Search ..... 5/60, 66–69, 5/80; 247/429, 432

[56] References Cited

U.S. PATENT DOCUMENTS

| | | | |
|---|---|---|---|
| 1,607,420 | 11/1926 | Williams | 5/68 |
| 2,452,366 | 10/1948 | Freund . | |
| 3,636,573 | 1/1972 | Bartz . | |
| 3,964,786 | 6/1976 | Mashuda . | |
| 4,083,599 | 4/1978 | Gaffney . | |
| 4,183,109 | 1/1980 | Howell . | |

FOREIGN PATENT DOCUMENTS

| | | | |
|---|---|---|---|
| 649038 | 9/1962 | Canada | 5/60 |

*Primary Examiner*—Francis K. Zugel
*Assistant Examiner*—Michael F. Trettel
*Attorney, Agent, or Firm*—Litman, Day and McMahon

[57] ABSTRACT

An adjustable bed is particularly adapted for the care of morbidly obese patients and comprises a ground engaging frame with a mattress support including a head section, a center section and a foot section which are hingedly interconnected and have power devices which selectively drive lift arms to raise and lower the head and foot sections relative to the center section. To assist entry and exit of a patient onto and off of the bed, a foldable step arrangement is provided which is connected to the foot section and automatically unfolds as the foot section is tilted downward to form a step and folds compactly as the foot section is raised to a horizontal position.

10 Claims, 8 Drawing Figures

Fig. 2.
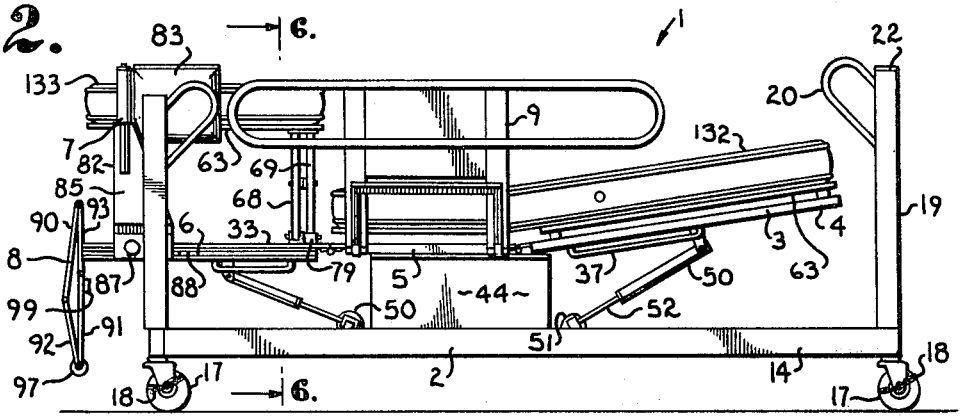
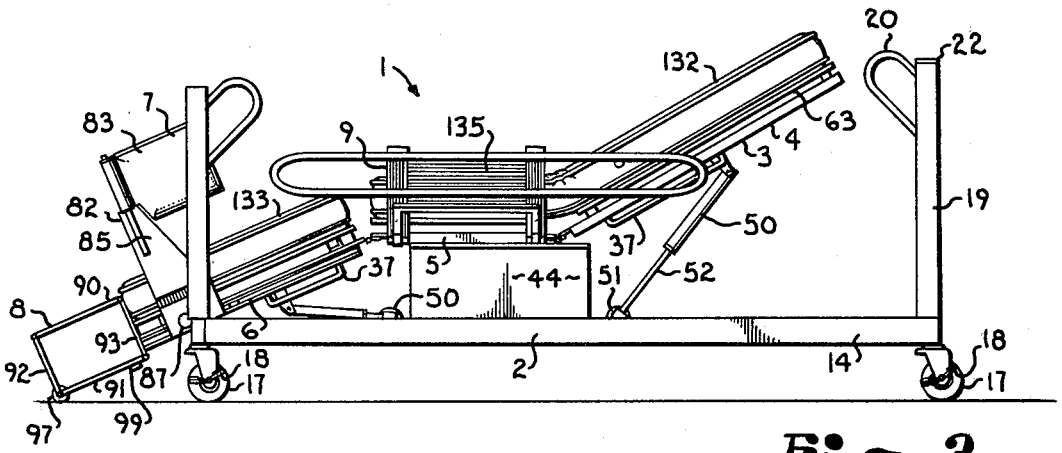
Fig. 3.
Fig. 4.
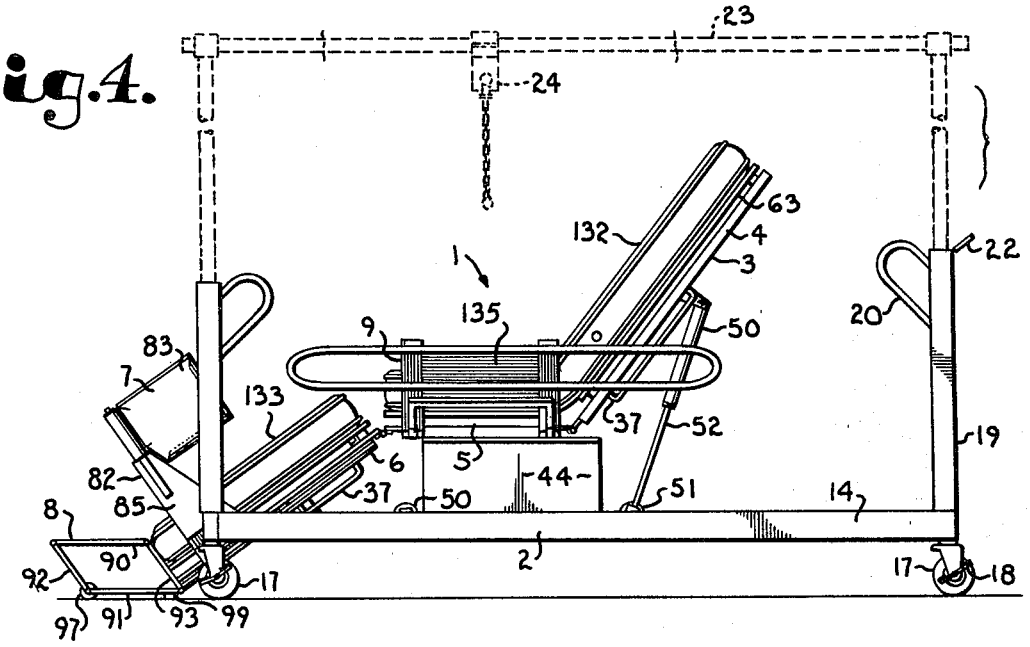

FOLDABLE STEP ARRANGEMENT FOR BEDS

BACKGROUND OF THE INVENTION

This invention relates to adjustable beds, and in particular to an adjustable bed specifically adapted for the care of morbidly obese patients.

The morbidly obese patient; that is, one who weighs over twice as much as his or her maximum recommended body weight faces particular problems in hospital care and management. Such patients typically weigh between 300 and 700 pounds and existing hospital beds are typically not sufficiently sturdy to support such bulk. Because of excessive weight, the morbidly obese patient is often subject to a variety of associated health problems and may be unable to move from the bed without assistance. The bed thus becomes, in effect, a semi-permanent home in which the patient eats, sleeps, reads, watches television, and the like.

Because it is so difficult to transfer such patients from their beds to patient transport carts, X-ray tables and the like, the patients are preferably transported in their beds to health care subfacilities. Further, such patients typically experience great difficulty just climbing into and out of bed and often have to be assisted to avoid injury or exhaustion.

OBJECTS OF THE INVENTION

The principle objects of the present invention are: to provide an adjustable bed specifically adapted for use by morbidly obese patients; to provide such a bed of great structural rigidity and strength to accommodate patients weighing between 300 and 700 pounds; to provide such a bed having means for adjusting a mattress and mattress support in various positions and attitudes for patient comfort and treatment; to provide such a bed which is easily movable from hospital rooms to corridors and health care facility rooms while with the patient thereon, and back again to the patient's room; to provide such a bed having a portable power means therewith for powered operation of associated life support systems for the patient; to provide such a bed having X-ray transparent panels thereon providing an area for insertion of X-ray film material to accommodate X-raying the patient while on the bed; to provide such a bed which accommodates an overhead traction frame for exercise and to assist in lifting the patient; to provide such a bed having a foldable foot rest therewith for comfort of the patient; to provide such a bed having a foldable step arrangement at the end of a foot section to facilitate movement onto and off of the bed by a patient; to provide such a bed step arrangement which automatically unfolds as a foot section swings downwardly and folds as the foot section swings upwardly; to provide such a step arrangement having a broad upper step surface to support a patient's foot; to provide such a step arrangement having automatically extending, spaced, floor engaging supports to provide sturdy braces for the upper step surface; and to provide such a bed which is economical to manufacture, efficient and sturdy in use, and particularly well adapted for the proposed use.

Other objects and advantages of this invention will become apparent from the following description taken in connection with the accompanying drawings wherein are set forth, by way of illustration and example, a certain embodiment of this invention.

BRIEF DESCRIPTION OF THE DRAWINGS

FIG. 2 is a side elevational view of the adjustable bed with head and foot and step arrangement sections in a first movement position.

FIG. 3 is a side elevational view of the adjustable bed with head and foot sections and step arrangement in a second movement position.

FIG. 4 is a side elevational view of the adjustable bed with head and foot sections and step arrangement in a third movement position.

DESCRIPTION OF THE PREFERRED EMBODIMENT

Figure 1:
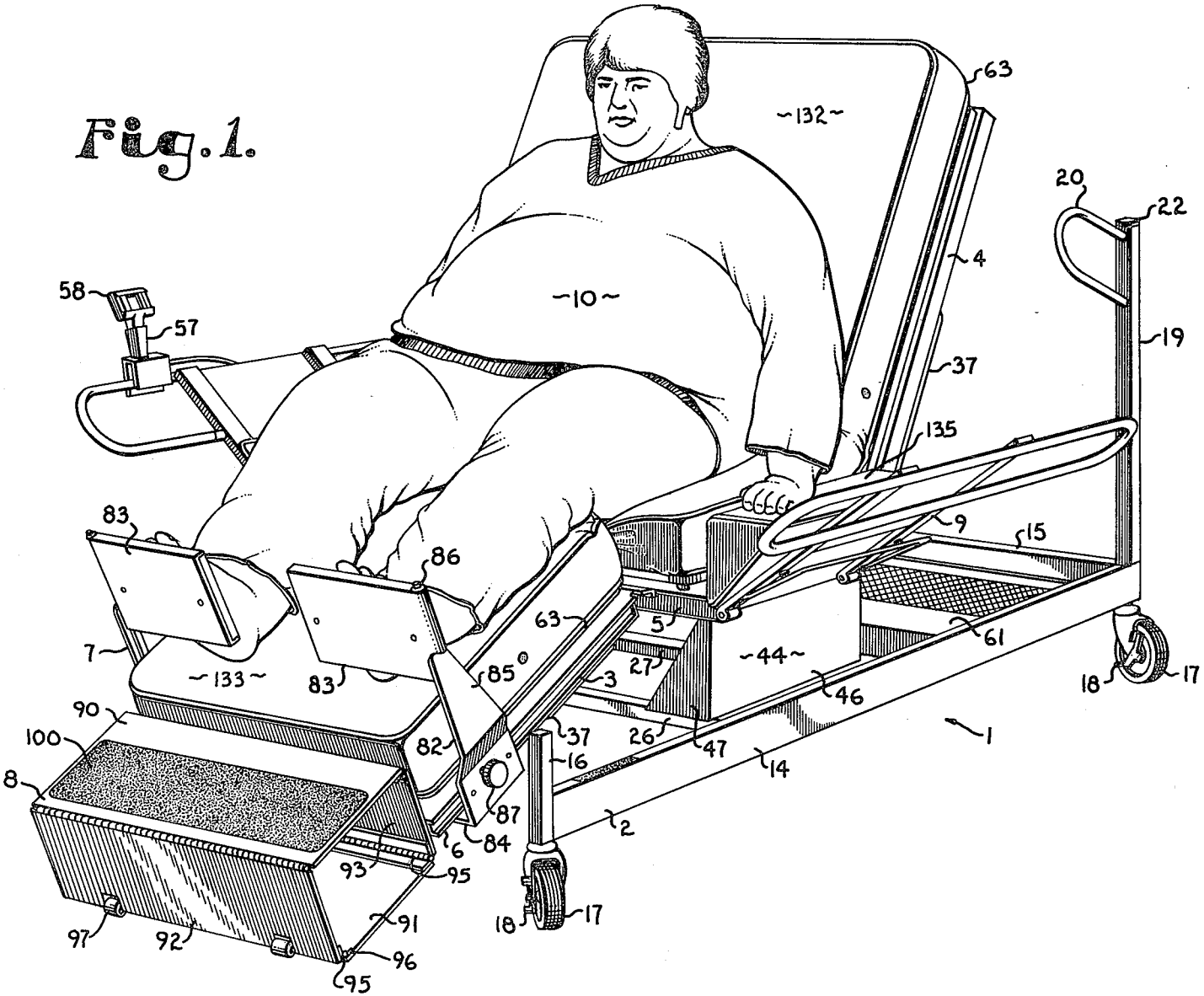
FIG. 1 is a perspective view of an adjustable bed embodying the present invention and with a morbidly obese patient reclining thereon.

As required, a detailed embodiment of the present invention is disclosed herein, however, it is to be understood that the disclosed embodiment is merely exemplary of the invention which may be embodied in various forms. Therefore, specific structural and functional details disclosed herein are not to be interpreted as limiting, but merely as a basis for the claims, and as a representative basis for teaching one skilled in the art to variously employ the present invention in virtually any appropriately detailed structure.

Referring to the drawings in more detal:

For purposes of description herein, the terms "upper", "lower", "right", "left", "rear", "front", "vertical", "horizontal", and derivitives thereof, shall relate to the invention as oriented in FIG. 1, however, it is to be understood that the invention may assume various alternative orientations, except where expressly specified to the contrary.

The reference numeral 1 generally designates an adjustable bed embodying the present invention. The adjustable bed 1 comprises a floor engaging frame 2 and a mattress support 3 having a head section 4, center section 5, and a foot section 6 pivotally interconnected. Foot rests 7 provide patient comfort and a foldable foot step arrangement 8 facilitates ease of entry and exit from the bed 1.

Side arms 9 are pivotally connected to opposite sides of the center section 5 and include rotation locking means at positions to provide support to confine a patient 10 on the bed and to selectively provide additional restive area.

The frame 2 is a stationary, ground engaging structure adapted to support the patient 10 and the mattress support 3 above the ground or floor surface. In the illustrated example, the frame 2 includes a pair of parallel, longitudinally extending side rails 13 and 14 which are interconnected at the head of the frame by a laterally extending cross member 15. End posts 16 are affixed to opposite ends of the side rails 13 and 14 and have wheels 17 pivotally affixed to lower ends thereof. The wheels 17 are preferably provided with brakes 18 to selectively prevent inadvertent movement over the a floor surface. Upright end members 19 have open lower ends which telescope over the end posts 16 and have upper ends with hand holds 20 affixed thereto to facilitate movement of the bed 1, as when wheeling the bed from room to room and through corridors and the like for movement of the patient 10.

Upper ends of the end members 19 are preferably provided with spring loaded end caps 22 which depress to provide access to the open interior of the respective end member 19 for insertion of an overhead traction frame 23, FIG. 4. The traction frame 23 has a trapeze bar 24 for exercise of the patient or to assist and ease the patient into and off of the bed. Alternatively, intravenous administration equipment supports (not shown) may be inserted in the end members 19.

Transverse cross braces 26 and 27 extend between the side rails 13 and 14 at medial locations for mounting the mattress support 3. A platform 29, FIG. 8, extends between the side rails 13 and 14 headwardly of the cross brace 27 for support of a battery pack means described below.

Figure 5:
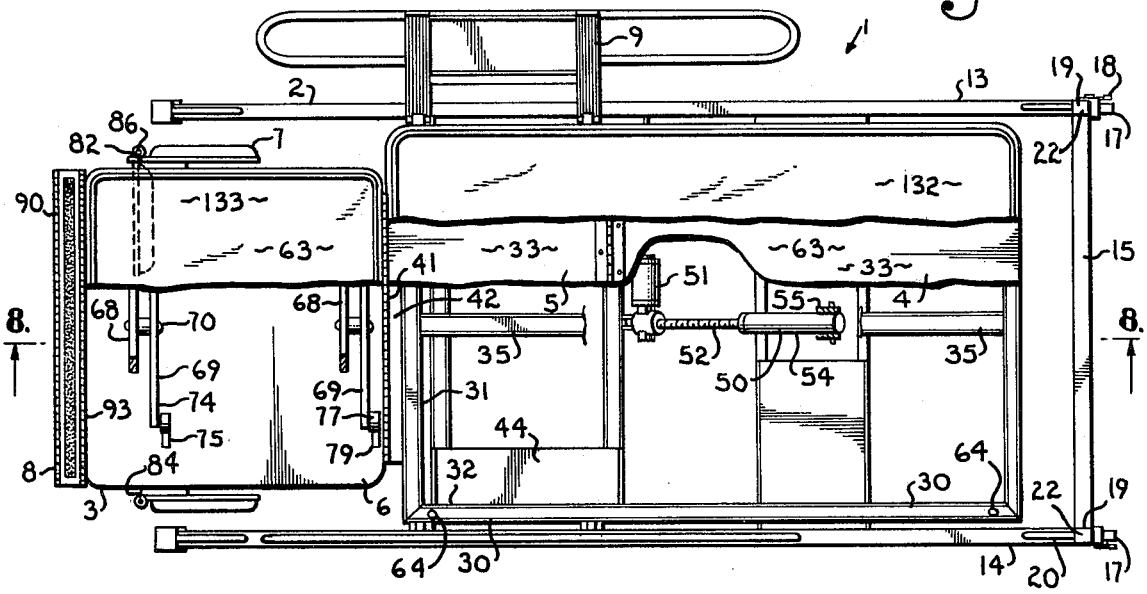
FIG. 5 is a top plan fragmentary view of the adjustable bed showing details thereof.

As best shown in FIG. 5, each of the sections 4, 5 and 6 of the mattress support 3 has a generally rectangular shape, and includes a rigid, peripheral frame 30, such as of angle beam elements with interconnected end and side members 31 and 32. A flat plate or sheet 33 overlies each of the peripheral frames 30 and is attached thereto by suitable fasteners, and preferably by means which will not interfere with the comfort of the bed, such as welds disposed along the frame 30 on the exterior side or top of the sheet 33. Each of the mattress sections 4, 5 and 6 also includes a medial brace member 35 extending between the end members 31 of the respective frames 30.

In the illustrated example, hold downs 37, such as for restraining straps (not shown) to prevent harm to the patient are affixed to each of the side members 32 of the peripheral frame 30 of the head section 4 and the foot section 6.

Figure 8:
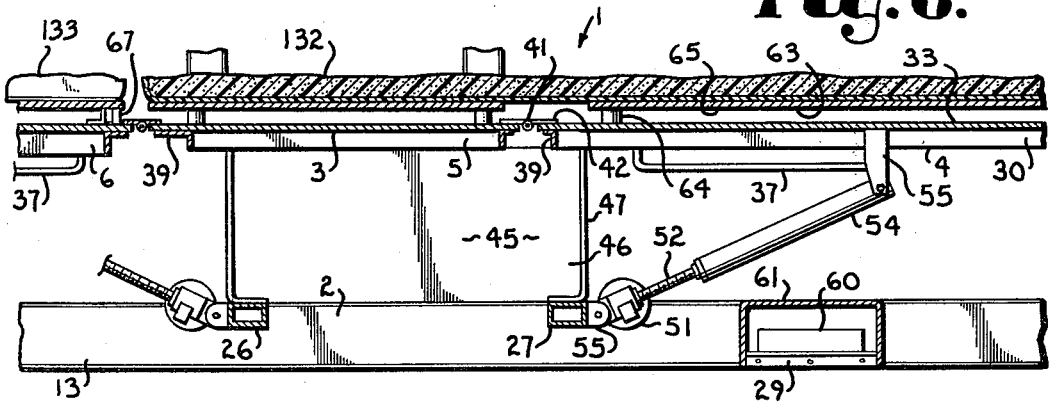
FIG. 8 is a longitudinal sectional view of the adjustable bed taken along lines 8—8, FIG. 5.

The adjacent end members 31 of adjoining sections 4, 5 and 6 are reinforced by angle beams 39, FIG. 8, for additional structural rigidity. The angle beams 39 are L-shaped in cross section and have one web disposed against the end member 31 and the other web contacting the bottom side of the flat plate or sheet 33 and extending along the end edge thereof. The adjacent frame end edges of the head section 4 and foot section 6 are interconnected to the center section 5 by respective piano hinges 41. Outwardly extending hinge plates 42 extend over a portion of the end of the flat plate or sheet 33 and have fasteners extending therethrough and securing the hinge plates 42 to the associated web portions of the angle beams 39.

Figure 7:
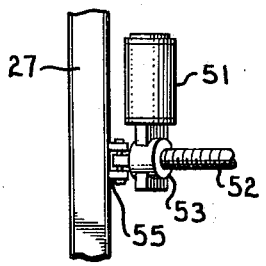
FIG. 7 is an enlarged fragmentary view of an adjustment motor means for tilting the head and foot sections.

The entire interconnected mattress support 3 is positioned above the frame 2 by spaced pedestals 44 and 45, FIG. 8, each including an upright plate portion 46 and opposite side gussets 47. The upper edge of the plate portion 46 is secured throughout most of the length thereof to the flat plate or sheet 33 of the center section 5, thereby supporting the mattress support 3 a distance above the frame 2 for positioning the patient 10 at a normal bed height and permitting downward swinging or lowering of the foot section 6 to a sufficient angle for comfort. Spaced lift means 50 respectively extend between the frame 2 and the head and foot sections 4 and 6 for tilting the head and foot sections 4 and 6 with respect to the center section 5. In the illustrated example, each lift means 50 includes a motor 51 rotatably driving a jack screw 52. The illustrated motor 51 is operable in either rotational direction. One end of the helical jack screw 52 is mounted in a transmission 53, FIG. 7 and is operably connected therewith whereby activation of the electric motor 51 rotates the screw 52. The other end of the screw 52 is threadably connected in an elongated sleeve member 54 having a plurality of anti-friction balls mounted on the interior portion thereof which engage the root of the screw 54 for smooth, secure engagement therewith. Rotation of the screw 52 in one direction pulls the sleeve 54 convergingly toward the motor 51, and rotation of the screw in the opposite direction pushes the sleeve divergingly apart from the motor. Pin and clevis hinge connections 55 respectively at opposite ends of the lift means 50 connect the motor 51 to the respective cross brace 26 or 27 and the end of the sleeve member 54 to the frame brace member 35. Thus, operation of the respective lift means 50 at the head and foot sections 4 and 6 causes same to pivot about the respective hinges 41 and move either upwardly or downwardly as selected. Each motor 51 and transmission 53 include internal braking means whereby the jack screw 52 is nonrotatable in the transmission 53 except when the motor 51 is actuated. Each of the motors 51 is electrically connected with a circuit arrangement for selectively activating each of the motors and controlling the direction of rotation thereof. Preferably, each motor is activated by currents of 12 volts DC. A hand held switching controller 57 is provided for operation of the motors 51 and has push button switches 58 therein for manipulation.

A battery pack 60 is positioned on one end of the platform 29 and connected by suitable circuitry to a battery charger. Switches activated by the controller 57 route electricity to the motors 51 for activation thereof. An outlet socket associated with the battery pack 60 permits battery powered operation of life support systems such as resuscitators and the like. A diagnostic indicator panel in a battery pack cover member 61 provides indication of battery charging and battery low voltage levels and additionally may include a buzzer for emission of a tone to indicate inadvertent disconnection of the battery pack 60 from a wall socket. If life support equipment, such as a resuscitator has electrical circuit lines thereof routed through the battery pack 60, such a buzzer would announce disconnection from the building power supply.

To permit the taking of X-ray photographs of the patient 10 while the patient is on the bed 1, provision is made for placement of X-ray film material between the head, center and foot sections 4, 5 and 6 and the patient 10 whereby the metal material of the sections 4, 5 and 6 does not interfere with the X-ray photograph. In the illustrated example, panel members 63 of X-ray passive material, such as wood particle board are mounted in overlying relation to the respective head, center and foot sections 4, 5 and 6 and positioned a distance thereabove by spacers 64, thereby creating a cavity 65 between the panel members 63 and the associated section 4, 5 or 6. The spacers 64 are arranged to provide unimpeded access to the cavity 65 for insertion of X-ray film material such as cassettes (not shown) for X-ray examination of thoracic, abdominal and leg regions.

Expansible spacers 67 are positioned between the panel member 63 and the underlying foot section 6 to permit elevation of the patient's legs.

Figure 6:
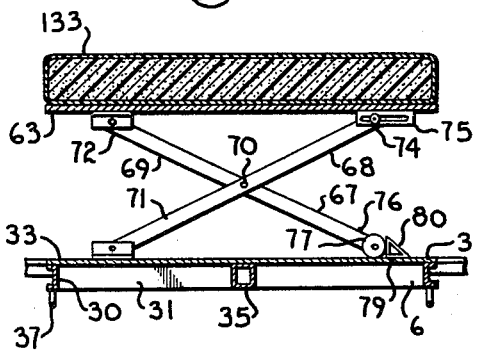
FIG. 6 is a fragmentary view of a foot section of the adjustable bed and showing an arrangement for raising a foot panel portion.

In the illustrated example, FIG. 6, the expansible spacers 67 include leg members 68 and 69 fixed together at a pivot 70 in a scissor jack arrangement. A lower end 71 of the leg 68 and an upper end 72 of the leg 67 are pivotally connected at fixed locations respectively to the foot section plate or sheet 33 and the panel member 63. An upper end 74 of the leg 68 is pivotally connected in a sliding hinge 75 to the lower surface of the panel member 63. A lower end 76 of the leg 69 has a roller 77 mounted thereon. The roller 77 is selectively engageable with a stop block 79 normally in the path of travel of the roller 77. The stop block 79 has an inclined ramp surface 80 on an upper portion thereof.

To elevate the panel member 63 of the foot section 6 from a down position, FIG. 3, to an up position, FIG. 2, the panel member 63 is grasped and pulled upwardly, urging the roller 77 over the ramp surface 80. The panel member 63 is then released so that the roller 77 rolls toward and engages the stop block 79 to prevent further movement, thereby positioning the panel member 63 in an upward or extended position. To return the panel member 63 to a lowered position, the panel member 63 is merely grasped and tilted to the left, FIG. 6, to draw the roller 77 upwardly and over the stop block 79 whereupon the panel member 63 can be lowered.

The foot rests 7 are provided for comfort of the patient 10 when the foot section 6 is in a downwardly tilted position, FIGS. 3 and 4. The foot rests 7 include a support structure 82 and rotatable foot members 83. The support structure 82 has a cross bar 84 extending transversely underneath the foot section 7 and arm members 85 connected to opposite ends thereof and extending upwardly of the panel member 63 and any mattress and placed thereon. Respective pin 86 extending upwardly from the arm members 85 provide a rotatable connection for the foot members 83 which are in the form of plates and have an upholstered surface for comfort. As shown in connection with FIG. 5, the foot members 83 are swingable on the pins 86 from a position over the foot section 6 to a stowed position aligned longitudinally forwardly or rearwardly with the bed.

Preferably, the foot rests 7 are adjustable longitudinally on the foot section 6 to adapt to the length of a particular patient 10 and in the illustrated example, have a spring loaded engagement pin 87 with a pawl end (not shown) extending through the lower portion of each arm member 85 and engageable with a selected one of a series of apertures 88 in the side members 32 of the frame 30 of the foot section 6. To adjust the foot section 7 to the height or length of a particular patient, the spring loaded engagement pins 87 of each arm member 85 are grasped and pulled outwardly and the foot rests 7 slid toward the head or foot end as necessary. Once properly positioned, the engagement pins 7 are released to snap into apertures generally aligned thereunder and thereby lock the foot rests 7 into position.

The foldable foot step arrangement 8 is affixed to the end of the foot section 6 to facilitate entry and exit of the patient 10 from the bed 1. The step arrangement 8 comprises a hingedly interconnected parallelogram frame arrangement having upper and lower arms 90 and 91 and opposite head end, or forward, and foot end, or rearward, legs 92 and 93.

Preferably, the respective upper and lower arms 90 and 91 and the legs 92 and 93 are of equal length. The arms 90 and 91 and legs 92 and 93 preferably extend the width of the foot section 6 to provide ease of access to the patient. The arms 90 and 91 and legs 92 and 93 are respectively rectangular and have spaced hinges 95 with hinge plates 96 secured to the marginal areas as by welding, rivets and the like.

Rollers 97 are rotatably mounted on the step arrangement 8 to facilitate unfolding and, in the illustrated example, are positioned in the hinge 95 between the lower arm 91 and foot end leg 92 with the hinge pin acting as the roller axle.

The head end leg 93 is secured to the foot section 6 adjacent the lower margin of the leg 93 so that the upper and lower arms 90 and 91 are substantially horizontal when the foot section 6 is fully swung downwardly, FIG. 4. Spaces pads 99 are affixed to the bottom surface of the lower arm 91 and engage the floor when the step arrangement 8 is fully lowered. The pads 99 and the rollers 97 thus provide sturdy support for the spaced legs 92 and 93 to support the upper arm 90 which forms a step platform when the step arrangement 8 is fully lowered.

The great weight of a morbidly obese patient, which could crush or distort otherwise arranged steps, is evenly distributed over the arm 90 and maintained by the legs 92 and 93 which are securely supported upon the floor.

To facilitate safe entry and exit of the patient, the upper surface of the arm 90 and the surfaces of the side rails 13 and 14 have a non-skid substance thereon, such as in the form of an applique 100, FIG. 1.

The side arms 9 are positioned on opposite sides of the center section 5 and are pivotally mounted thereto for rotation toward and away from the center section 5.

To complete the adjustable bed 1, a two-piece mattress is emplaced and has a combination center and head section mattress 132 and a foot section mattress 133. Preferably, a bolster 135 of triangular cross section is emplaced in the open area created by the side arms 9 in the outwardly swung position, FIG. 1, to provide additional restive area and support for the patient 10. Because of the great bulk of the morbidly obese patient and particularly the great width in the hip area of some morbidly obese women, the additional space or restive area acquired by affixing the side arms 9 at the outwardly swung position is of great benefit to provide comfort for the patient.

Preferably, the adjustable bed 1 has standard size traverse dimensions to accommodate passage through a normal width hospital door and the bed cannot normally pass therethrough with the side arms 9 in the outwardly swung position. To permit passage, the bolster 135 is simply lifted out and the side arm 9 swung to the upright position, FIG. 2, thereby providing confining support for the patient during movement and transport through corridors to various medical treatment rooms and the like.

It is to be understood that while one form of the invention has been illustrated and described, it is not to be limited to the specific form or arrangement of parts herein described and shown except insofar as set forth in the following claims.

What is claimed and desired to secure by Letters Patent is:

1. An adjustable bed comprising:

(a) a ground engaging frame;

(b) a mattress support including a head section, a center section, and a foot section, each section being pivotally interconnected and having opposite sides;

(c) said center section being mounted to said frame with said head and foot sections swingably attached to said center section for respective relative raising and lowering; and (d) a foldable step arrangement mounted to said foot section and having floor supported legs and a patient supportive upper surface; said step arrangement including means providing automatic unfolding into a use position as said foot section lowers and providing automatic folding into a nonuse position as said foot section raises.

2. The bed set forth in claim 1 including:

(a) panel members of X-ray passive material respectively mounted atop said head, center and foot sections;

(b) spacer members respectively extending between said head, center and foot sections and mounting said panel members thereabove, thereby retaining a space therebetween for insertion of X-ray film material.

3. The bed set forth in claim 2 including:

(a) expansible spacer members extending between said foot section and the panel member therewith;

(b) said expansible spacer members providing for positioning the panel member a considerable distance above said foot member for elevation of the legs of a patient.

4. The bed set forth in claim 3 wherein:

(a) said expansible spacer members include a scissor arrangement comprising pivotally joined, crossing legs.

5. The bed set forth in claim 1 including:

(a) foot rest members slidably mounted to said foot section for adjustment to the length of a patient;

(b) said foot rest members having swingably mounted foot support portions rotatable over said foot section from the opposite sides of said foot section.

6. The bed set forth in claim 1 wherein:

(a) said step arrangement floor supported legs and patient supportive upper surface are hingedly interconnected;

(b) said legs include forward and rearward legs with said forward leg being secured to said foot section.

7. The bed set forth in claim 6 wherein:

(a) said step arrangement is in the form of a parallelogram with said forward and rearward legs and having upper and lower arms with said upper arm providing said patient supportive upper surface, all of said legs and arms being interconnected by hinges for automatic folding and unfolding.

8. The bed set forth in claim 7 including:

(a) rollers mounted in said hinge at the juncture of said rearward leg and said lower arm for engagement with a floor surface;

(b) pads mounted to said lower arm adjacent the juncture thereof with said forward arm for level support of said arms when said step arrangement is in said use position.

9. The bed set forth in claim 7 including:

(a) a nonskid surface applique on said upper arm.

10. An adjustable bed for obese patients comprising:

(a) a heavy duty, ground engaging frame having wheels mounted thereto for movement over a floor surface;

(b) a central pedestal mounted atop said frame;

(c) a mattress support including head, center and foot sections having opposite sides and hinges swingably interconnecting said sections;

(d) said central pedestal supporting said center section a distance above said frame for respective raising and lowering of said head and foot sections relative to said center section;

(e) panel members of X-ray passive material mounted to said head, center and foot sections and positioned a distance thereabove by spacer members for insertion of X-ray film material;

(f) expansible spacer members extending between said foot section and the panel member thereabove for elevation of the legs of a patient;

(g) foot rests slidably mounted to said foot section for adjustment to the length of a patient and having swingably mounted foot plates rotatable over said foot section from the opposite sides of said foot section; and (h) a foldable step arrangement secured to said foot section for ease of entry and exit by a patient and having upper and lower arms and forward and rearward legs foldably interconnected by hinge means for automatic folding into a nonuse position as said foot section raises and unfolding into a use position as said foot section lowers, said upper and lower arms and forward and rearward legs being arranged in parallelogram relationship;

(i) said step arrangement including rollers mounting in said hinge means between said lower arm and said rearward leg and floor engaging pads mounted to said lower arm adjacent the juncture thereof with said forward leg for levelly supporting said upper arm.

* * * * *